US007258464B2

(12) United States Patent
Morris et al.

(10) Patent No.: US 7,258,464 B2
(45) Date of Patent: Aug. 21, 2007

(54) INTEGRAL BALLAST LAMP THERMAL MANAGEMENT METHOD AND APPARATUS

(75) Inventors: Garron K. Morris, Whitefish Bay, WI (US); Kamlesh Mundra, Clifton Park, NY (US); Ljubisa Dragoljub Stevanovic, Montreal (CA); Ashutosh Joshi, Bangalore (IN); Didier G. Rouaud, Twinsburg, OH (US); Janos G. Sarkozi, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 589 days.

(21) Appl. No.: 10/323,251

(22) Filed: Dec. 18, 2002

(65) Prior Publication Data

US 2004/0120148 A1 Jun. 24, 2004

(51) Int. Cl.
*F21V 29/00* (2006.01)

(52) U.S. Cl. ..... 362/264; 362/294; 362/373

(58) Field of Classification Search ..... 362/264, 362/373, 294, 345, 547, 580, 800, 261–265
See application file for complete search history.

(56) References Cited

U.S. PATENT DOCUMENTS

| | | | | | |
|---|---|---|---|---|---|
| 3,974,418 | A | | 8/1976 | Fridrich | 315/59 |
| 4,270,071 | A | | 5/1981 | Morton | 315/62 |
| 4,411,516 | A | * | 10/1983 | Adachi et al. | 355/67 |
| 4,414,615 | A | * | 11/1983 | Szeker et al. | 362/264 |
| 4,490,649 | A | | 12/1984 | Wang | 315/50 |
| 4,503,358 | A | | 3/1985 | Kamei et al. | 315/58 |
| 4,507,719 | A | * | 3/1985 | Quiogue | 362/404 |
| 4,630,182 | A | * | 12/1986 | Moroi et al. | 362/294 |
| 4,644,226 | A | | 2/1987 | Vernooij et al. | 315/50 |
| 4,780,062 | A | * | 10/1988 | Yamada et al. | 417/410.2 |
| 5,006,752 | A | | 4/1991 | Eggink et al. | 313/161 |
| 5,008,582 | A | | 4/1991 | Tanuma et al. | 310/332 |
| 5,130,912 | A | | 7/1992 | Friederichs et al. | 362/263 |
| 5,136,489 | A | * | 8/1992 | Cheng et al. | 362/294 |
| 5,355,054 | A | | 10/1994 | Van Lierop et al. | 315/112 |
| 5,386,354 | A | * | 1/1995 | Osteen | 362/258 |
| 5,458,505 | A | | 10/1995 | Prager | 439/485 |
| 5,572,083 | A | | 11/1996 | Antonis et al. | 313/46 |
| 5,621,266 | A | | 4/1997 | Popov et al. | 313/46 |
| 5,651,609 | A | | 7/1997 | Pelton et al. | 362/294 |
| 5,667,003 | A | * | 9/1997 | Mahdjuri-Sabet | 165/274 |
| 5,785,418 | A | * | 7/1998 | Hochstein | 362/373 |
| 5,801,493 | A | | 9/1998 | Antonis et al. | 315/248 |
| 5,861,703 | A | * | 1/1999 | Losinski | 310/330 |
| 5,908,418 | A | * | 6/1999 | Dority et al. | 606/40 |
| 6,081,070 | A | | 6/2000 | Popov et al. | 313/490 |

(Continued)

*Primary Examiner*—Ali Alavi
*Assistant Examiner*—Jason Moon Han
(74) *Attorney, Agent, or Firm*—Fletcher Yoder

(57) ABSTRACT

A lamp having a lighting source, integral electronics, and a thermal distribution mechanism disposed in a housing. The thermal distribution mechanism may include a For example, the lamp may include a thermal shield between the lighting source and the integral electronics. The lamp also may have a forced convection mechanism, such as an air-moving device, disposed adjacent the integral electronics. A heat pipe, a heat sink, or another conductive heat transfer member also may be disposed in thermal communication with one or more of the integral electronics. For example, the integral electronics may be mounted to a thermally conductive board. The housing itself also may be thermally conductive to conductively spread the heat and convect/radiate the heat away from the lamp.

29 Claims, 4 Drawing Sheets

U.S. PATENT DOCUMENTS 6,350,046 B1 * 2/2002 Lau ..... 362/364
6,511,209 B1 * 1/2003 Chiang ..... 362/294
6,517,221 B1 * 2/2003 Xie ..... 362/373
6,863,418 B2 * 3/2005 Masuoka et al. ..... 362/264
2003/0227774 A1 * 12/2003 Martin et al. ..... 362/240

* cited by examiner

FIG. 4
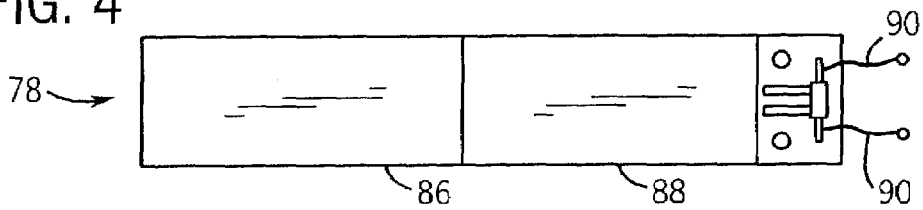
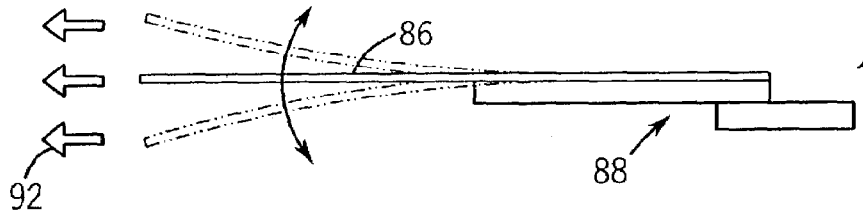
FIG. 5
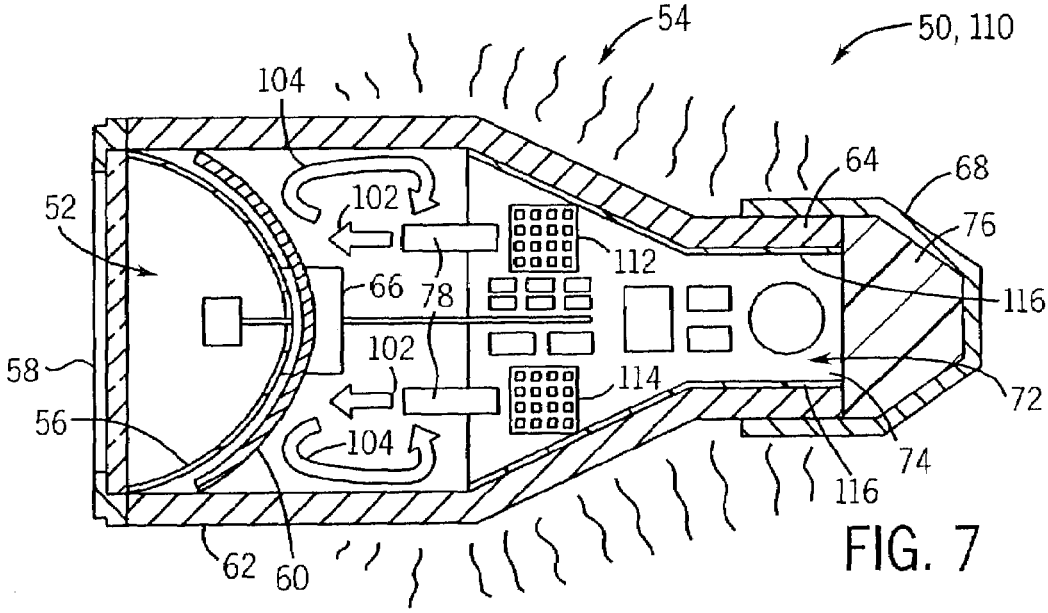
FIG. 7
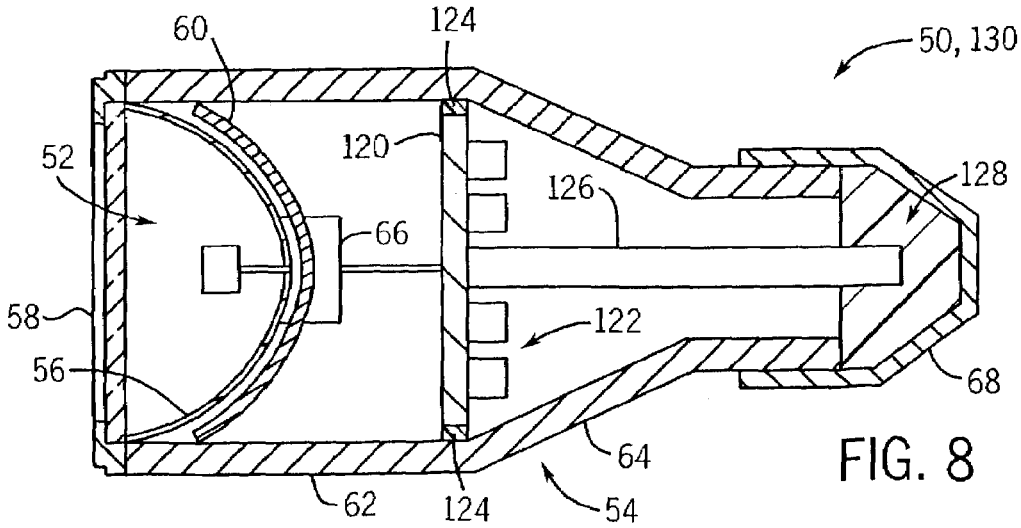
FIG. 8

INTEGRAL BALLAST LAMP THERMAL MANAGEMENT METHOD AND APPARATUS

BACKGROUND OF THE INVENTION

The present technique relates generally to the field of lighting systems and, more particularly, to heat control in lamps having integral electronics. Specifically, a lamp is provided with a heat distribution mechanism, which may comprise a thermal shield, a heat pipe, a heat sink, an air-moving device, and thermally conductive members.

Lighting companies have begun to develop integral electronics lamps in response to emerging market needs and trends. These integral electronics lamps generally comprises a light source and a plurality of integral electronics, such as MOSFETs, rectifiers, magnetics, and capacitors. Both the light source and the various electronics generate heat, which can exceed the component's temperature limits and damage the integral electronics lamp. In many of these integral electronics lamps, the light source and the integral electronics are disposed in a fixture, which further restricts airflow and reduces heat transfer away from the electronics. Existing integral electronics lamps are often rated at below 25 watts and, consequently, do not require advanced thermal control techniques. However, high wattage integral electronics lamps, i.e., greater than 30 watts, are an emerging market trend in which thermal management is a major hurdle. Various other lamps and lighting systems also suffer from heat control problems, such as those described above.

Accordingly, a technique is needed to address one or more of the foregoing problems in lighting systems, such as integral electronics lamps.

BRIEF DESCRIPTION OF THE INVENTION

A lamp having a lighting source, integral electronics, and a thermal distribution mechanism disposed in a housing. The thermal distribution mechanism may include a variety of insulative, radiative, conductive, and convective heat distribution techniques. For example, the lamp may include a thermal shield between the lighting source and the integral electronics. The lamp also may have a forced convection mechanism, such as an air-moving device, disposed adjacent the integral electronics. A heat pipe, a heat sink, or another conductive heat transfer member also may be disposed in thermal communication with one or more of the integral electronics. For example, the integral electronics may be mounted to a thermally conductive board. The housing itself also may be thermally conductive to conductively spread the heat and convect/radiate the heat away from the lamp.

BRIEF DESCRIPTION OF THE DRAWINGS

The foregoing and other advantages and features of the invention will become apparent upon reading the following detailed description and upon reference to the drawings in which:

FIG. 4 is a cross-sectional side view illustrating an embodiment of the integral electronics lamp of FIG. 2 having a curved thermal shield and an air-moving device disposed therein;

FIG. 5 is a top view of the air-moving device illustrated in FIGS. 3 and 4;

FIG. 7 is a cross-sectional side view illustrating an embodiment of the integral electronics lamp of FIG. 2 having a curved thermal shield, an air-moving device, and a heat sink disposed therein;

FIGS. 8-10 are cross-sectional side views illustrating embodiments of the integral electronics lamp of FIG. 2 having a curved thermal shield, a thermally conductive electronics board, and various heat transfer members disposed therein.

DETAILED DESCRIPTION OF SPECIFIC EMBODIMENTS

Figure 1:
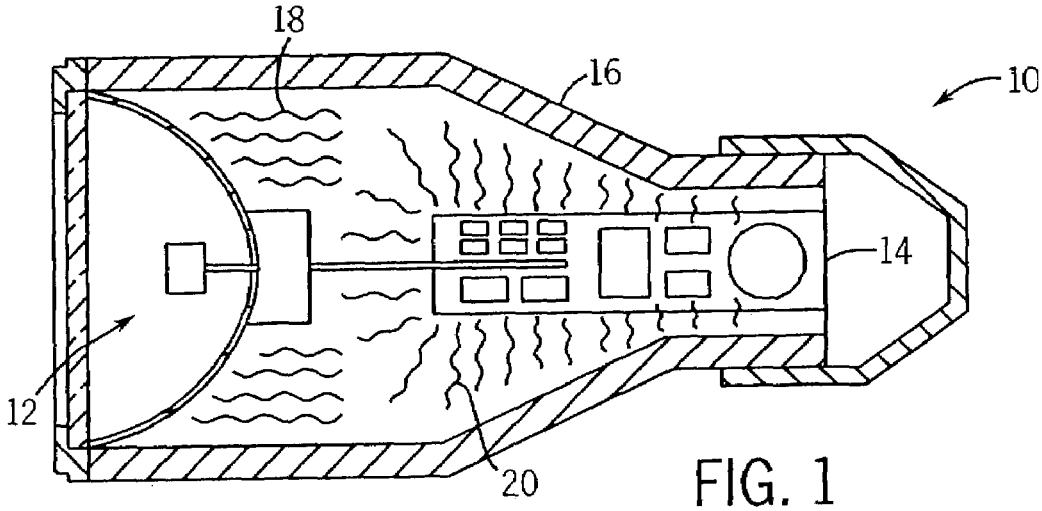
FIG. 1 is a cross-sectional side view illustrating heat generated by a light source and electronics disposed within a lamp.

As noted above, lighting systems often have undesirable thermal gradients and other heating problems, which affect the performance, longevity, and operability of the lamp and the integral electronics. FIG. 1 illustrates typical heating characteristics in a lamp 10, which has a light source 12 and electronics 14 disposed within a closed housing 16. As illustrated, the lamp 10 generates heat 18 from the light source 12 and heat 20 from the electronics 14. The present technique provides a unique thermal distribution mechanism, which is particularly well-suited for distributing the heat 18 and 20 to provide a desired heat profile in the lamp 10. As described in detail below, the thermal distribution mechanism may comprise a variety of insulative, radiative, convective, and conductive thermal transfer mechanisms inside and outside of the closed housing 16. Although the thermal distribution mechanism may be used with any type or configuration of lighting systems, various aspects of the present technique will be described with reference to an integral electronics lamp.

An exemplary integral electronics lamp 50 is illustrated with reference to FIG. 2. In this perspective view, the integral electronics lamp 50 can be observed to have a light source 52 exploded from a housing 54. The light source 52 may comprise a variety of lighting components, structures, materials, reflectors, lenses, electrodes, arc tips, luminous gases, and so forth. In the illustrated embodiment, the light source 52 includes a parabolic reflector 56 and a top retainer 58, which house various lighting mechanisms (not shown). For example, the light source 52 may comprise a high-intensity discharge (HID) lamp, a halogen lamp, quartz lamp, an ultrahigh pressure (UHP) lamp, a ceramic metal halide (CMH) lamp, a high-pressure sodium (HPS) lamp, yttrium-aluminum-garnet (YAG) lamp, a sapphire lamp, a projector lamp, and so forth. The integral electronics lamp 50 also includes an exemplary component, i.e., a thermal shield 60, of the foregoing thermal distribution mechanism.

As discussed in detail below, the thermal shield 60 may comprise a variety of structures, shapes, conductive materials, insulative materials, and so forth. In the illustrated embodiment, the thermal shield 60 has a generally flat structure comprising a thermally conductive material coated with a thermally insulative material. Alternatively, the thermal shield 60 may have a generally curved shape, e.g., a parabolic shape, tailored to the geometry of the reflector 56. Any other shape is also within the scope of the present technique. Regarding materials, the thermally conductive material may comprise copper, aluminum, steel, and so forth. The thermally insulative material may comprise an integral layer or coating, such as a layer of highly insulating paint. An exemplary insulative paint coating may be obtained from Thermal Control Coatings, Inc., Atlanta, Ga. In operation, the thermally conductive material of the thermal shield 60 transfers heat away from the reflector 56, while the thermally insulative material blocks heat from traveling further into the housing 54. Accordingly, the thermal shield 60 operates more efficiently by having a good thermal contact with both the reflector 56 and the internal wall off the housing 54. This heat transfer away from the light source 52 and reflector 56 is particularly advantageous, because of the relatively high temperatures in the vicinity of the light source 52. Alternatively, the thermal shield 60 may comprise only an insulative material.

Figure 2:
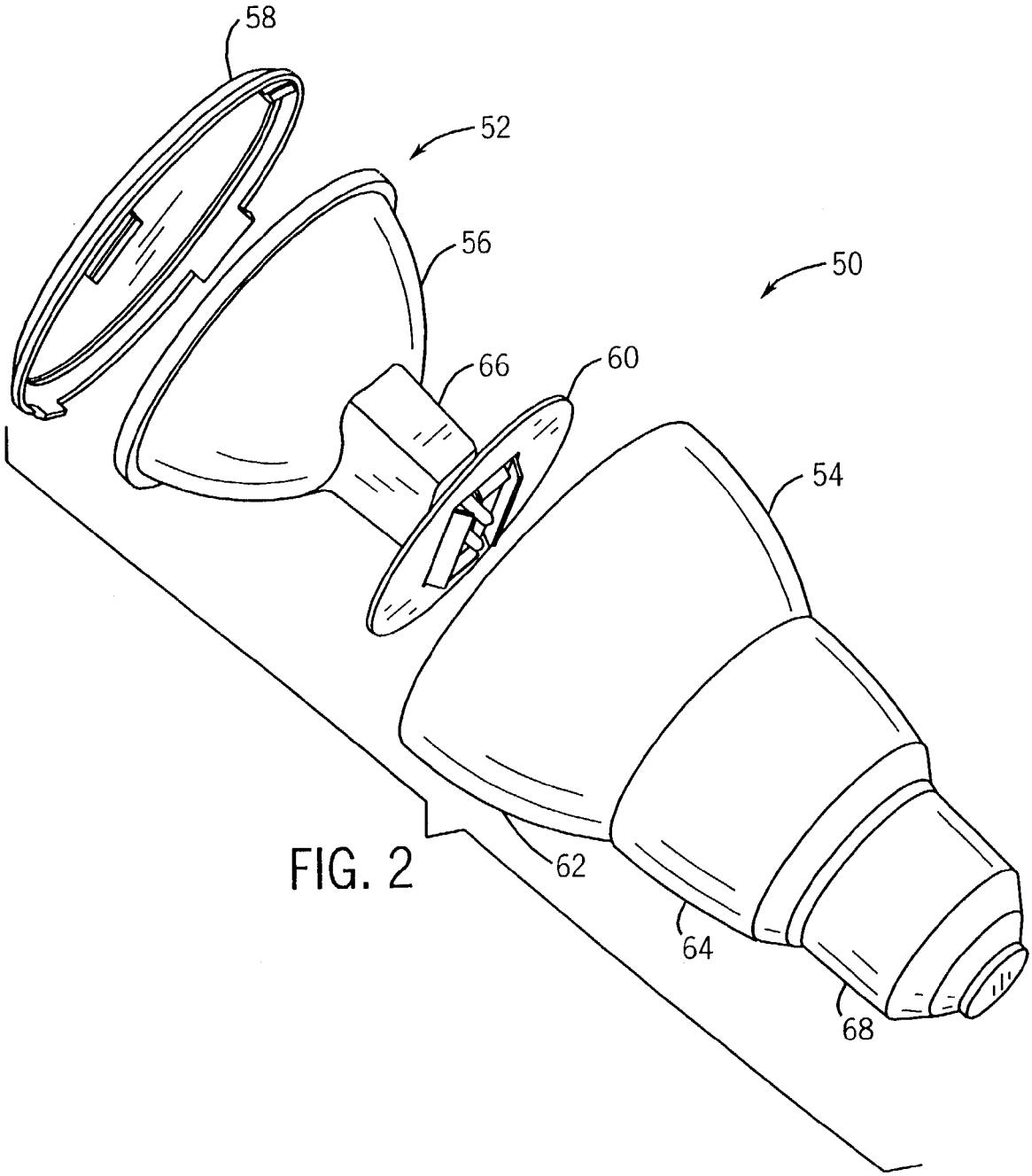
FIG. 2 is a perspective view illustrating an exemplary integral electronics lamp of the present technique.

In assembly, the light source 52 of FIG. 2 is disposed in a light region 62 of the housing 54, while the integral electronics (not shown) are disposed in an electronics region 64 of the housing 54. Between the light source 52 and the integral electronics, the thermal shield 60 provides a thermal barrier to prevent heat generated by the light source 52 from reaching the integral electronics disposed within the electronics region 64. In the illustrated embodiment, the thermally insulative and conductive thermal shield 60 is disposed about a pinch region or central portion 66 of the light source 52 (i.e., where the reflector 56 meets the light source 52), such that heat may be thermally conducted away from the light source 52. The pinch region or central portion 66 generally becomes very hot, so the thermal shield 60 transfers heat away from this region 66 to maintain an acceptable temperature. For example, as described in detail below, the thermal shield 60 may be conductively coupled to both the central portion 66 and a thermally conductive portion of the housing 54 to transfer heat out through the housing 54. Accordingly, heat is distributed rather than being allowed to create hot spots or temperature gradients in the lamp 50.

Opposite the light source 52, the housing 54 of FIG. 2 has an Edison base or connection mount 68, which is attachable to an electrical fixture. For example, the connection mount 68 may be attached to a portable lamp, an industrial machine, a processor-based product, a video display, and so forth. Depending on the desired application, the connection mount 68 may comprise threads, a slot, a pin, a mechanical latch, or any other suitable electrical and mechanical attachment mechanisms. The connection mount 68 also may be filled with a thermally conductive joining material or potting material, as discussed in further detail below.

As noted above, the lamp 50 of the present technique may comprise a wide variety of thermal distribution mechanisms, such as the thermal shield 60 and other heat transfer mechanisms, to provide the desired heat profile in the lamp 50. Accordingly, various embodiments of the lamp 50 are discussed below with reference to FIGS. 3-11. It should be kept in mind that the these embodiments are merely illustrative of potential types and combinations of thermal distribution mechanisms, while other combinations of heat shielding and transfer mechanisms are within the scope of the present technique.

Figure 3:
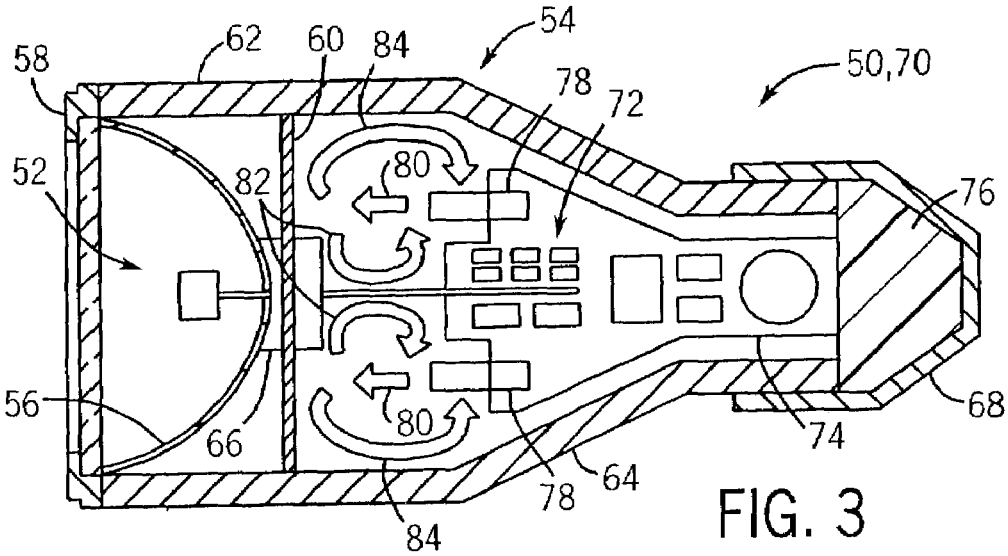
FIG. 3 is a cross-sectional side view illustrating an embodiment of the integral electronics lamp of FIG. 2 having a flat thermal shield and an air-moving device disposed therein.

Turning to FIG. 3, a cross-sectional side view of the lamp 50 is provided to illustrate an exemplary thermal distribution mechanism 70. In illustrated embodiment, the lamp 50 has integral electronics 72 mounted to a board 74 in the electronics region 64 of the housing 54, while the light source 52 and thermal shield 60 are disposed in the light region 62. The integral electronics 72 may comprise a variety of resistors, capacitors, MOSFETs, ballasts, power semiconductors, integrated circuits, rectifiers, magnetics, and so forth. As discussed above, the thermal shield 60 insulates or blocks heat generated by the light source 52 from passing to the integral electronics 72. In addition to a thermally insulating material, the illustrated thermal shield 60 has a thermally conductive material extending from the central portion 66 to the light region 62 of the housing 54. In operation, the light source 52 substantially heats the central portion 66, where the conductive material in the thermal shield 60 transfers the heat radially outwardly into the housing 54. In this exemplary embodiment, at least a portion of the housing 54 (e.g., the light region 62) comprises a thermally conductive material, such that the foregoing light-based heat can distribute through the housing 54 and into the atmosphere via radiation and/or convection.

In the electronics region 64, the thermal distribution mechanism 70 of FIG. 3 also may include one or more heat transfer mechanisms, such as a forced convection or conductive heat transfer mechanism. As illustrated, the board 74 extends lengthwise within the housing 54 from the electronics region 64 to the connection mount 68. In this exemplary embodiment, the board 74 comprises a thermally conductive substrate, which is a thermally coupled to the connection mount 68 via a potting material 76. For example, the board 74 may be formed from a metal substrate, such as copper. In the mounting base 68, a variety of different thermally conductive substances or potting materials may be disposed between the board 74 and walls of the mounting base 68. This potting material may be disposed completely around the board 74, along its edges, or in any other configuration sufficient to facilitate heat transfer. Accordingly, heat generated by the integral electronics 72 may be transferred through the board 74 and out through the mounting base 68.

The illustrated thermal distribution mechanism 70 of FIG. 3 also includes a forced convection mechanism, e.g., air-moving devices 78. In operation, the air-moving devices 78 circulate the air (or other medium) within the housing 54 and across the integral electronics 72. Arrows 80, 82, and 84 illustrate exemplary fan-induced circulation paths, which may vary depending on the particular geometry of the housing 54 and the orientation of the air-moving devices 78. The fan-induced circulation effectively increases convection and reduces the temperature of the integral electronics 72. The air-moving devices 78 also reduce the impact of the lamp's orientation, because the fan-induced circulation makes the conductive heat transfer independent of gravity.

These air-moving devices 78 may comprise a wide variety of air-moving mechanisms, such as miniature fans, piezoelectric fans, ultrasonic fans, and various other suitable air-moving devices. One exemplary embodiment of the air-moving devices is a piezoelectric fan, such as those provided by Piezo Systems, Inc., Cambridge, Mass. These piezoelectric fans are instantly startable with no power surge (making them desirable for spot cooling), ultra-lightweight, thin profile, low magnetic permeability, and relatively low heat dissipation. An embodiment of the air-moving devices 78, e.g., a piezoelectric fan, is illustrated with reference to FIGS. 4 and 5. As illustrated, the air-moving devices 78 have a flexible blade 86 (e.g., Milar or stainless steel) coupled to a piezoelectric bending element 88, which may include leads 90 for integrating the air-moving devices 78 into the lamp 50. In operation, the piezoelectric bending element 88 oscillates the flexible blade 86 at its resonant vibration, thereby forming a unidirectional flow stream as indicated by arrows 92. Again, the present technique may utilize other suitable air-moving devices depending on the desired application, size constraints, desired characteristics, and so forth. In any of the embodiments of the present technique, one or more of these air-moving devices 78 may be disposed within the housing 54 to force convective heat transfer. The air-moving devices 78 may be oriented in the same direction, in opposite directions, or in any other configuration to achieve the desired circulation within the housing 54.

Figure 6:
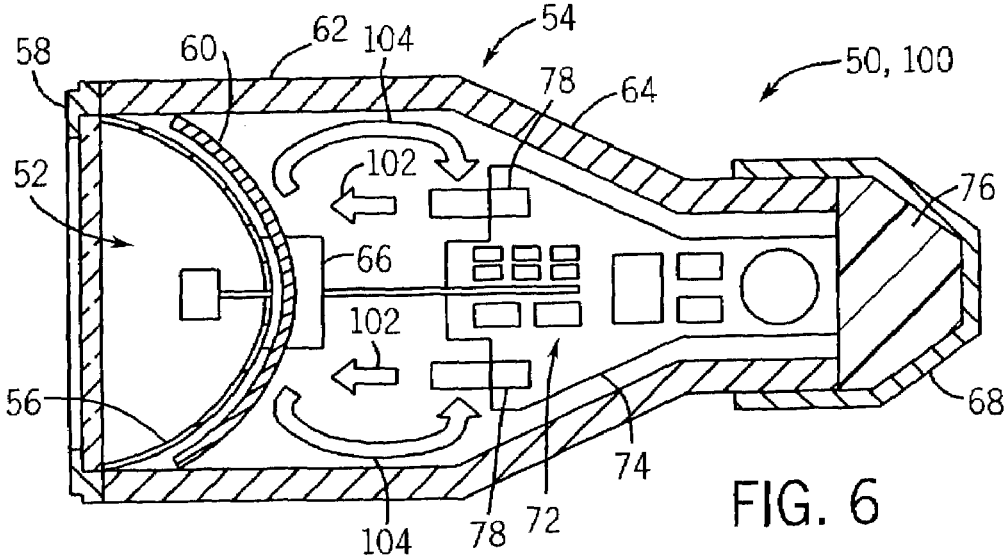
FIG. 6 is a side view of the air-moving device illustrated in FIGS. 3 and 4.

Another thermal distribution system 100 is illustrated with reference to FIG. 6, which is a cross-sectional side view of an alternate embodiment of the lamp 50. The illustrated embodiment of FIG. 6 is similar to that of FIG. 3, except that the thermal shield 60 has a generally curved shape extending around the reflector 56. The curved shape may be concave, parabolic, or generally parallel to the surface of the reflector. Any other shape of the thermal shield 60 is also within the scope of the present technique. However, the particular geometry of the thermal shield 60 may enhance its effectiveness as an insulator against thermal radiation. For example, the illustrated curved shape of the thermal shield 60 advantageously provides a greater shielding surface than the flat shape of FIG. 3. Again, the illustrated thermal shield 60 may comprise a thermally conductive material to facilitate heat transfer outwardly from the light source 52, i.e., the central portion 66, to the housing 54. Upon reaching the housing 54, the transferred heat may be convected and/or radiated away from the lamp 10.

In the electronics region 64 of FIG. 6, the thermal distribution mechanism 100 of FIG. 6 also may include one or more heat transfer mechanisms, such as a forced convection or conductive heat transfer mechanism. In the illustrated embodiment, the curved geometry of the thermal shield 60 may alter the heat profile in the lamp 50 relative to that of the flat thermal shield 60 of FIG. 3. Accordingly, the heat transfer mechanisms in the illustrated embodiment may differ from those of FIG. 3. As illustrated, the board 74 supporting the integral electronics may have a thermally conductive substrate to distribute heat generated by the integral electronics 72. The board 74 also may be thermally coupled to the connection mount 68 via a thermally conductive substance, such as the potting material 76. Accordingly, heat generated by the integral electronics 72 can pass through the board 74 and out through the mounting base 68. The thermal distribution mechanism 100 also includes a forced convection mechanism, e.g., the air-moving devices 78. As discussed above, the air-moving devices 78 circulate the air (or other medium) within the housing 54 and across the integral electronics 72. Given the different, i.e., curved geometry, of the thermal shield 60, the forced circulation of the illustrated embodiment may differ from that of FIG. 3. Arrows 102 and 104 illustrate exemplary fan-induced circulation paths, which increase convection and reduce the temperature of the integral electronics 72.

In addition to the foregoing heat distribution mechanisms, the lamp 50 of the present technique may comprise one or more heat pipes, heat sinks, or other heat transfer mechanisms. In FIG. 7, an alternative heat distribution mechanism 110 is illustrated for controlling heat within the lamp 50. Similar to the embodiments described above, the lamp 50 includes the thermal shield 60 (e.g., a curved structure) to insulate or block heat from the light source 52. Additionally, the board 74 supporting the integral electronics 72 includes heat sinks 112 and 114 disposed adjacent the air-moving devices 78. The heat sinks 112 and 114 may comprise any suitable material and structure that increases the surface area for forced convection by the air-moving devices 78. The present technique also may use one or more heat sinks without the air-moving devices 78. Again, the board 74 and housing 54 may comprise a thermally conductive material to transfer and distribute heat away from the integral electronics 72. Upon reaching the housing 54, the heat transfers or distributes conductively, radiatively, and convectively away from the lamp 50. Moreover, the board 74 may be coupled to the connection mount 68 via a thermally conductive substance, such as the potting material 76. If the lamp 50 is coupled to an external fixture, then heat can distribute out through the connection mount 68 and into the fixture.

FIGS. 8-11 illustrate alternative embodiments of the lamp 50 having a cross-mounted board 120 supporting integral electronics 122. In each of these embodiments, the lamp 50 includes the thermal shield 60 (e.g., a curved or parabolic structure) disposed adjacent the light source 52. Accordingly, heat generated by the light source 52 is insulated or blocked from the integral electronics 122 in the electronics region 64. Moreover, one or more of the housing 54, the connection mount 68, and the cross-mounted board 120 may comprise a thermally conductive material to facilitate heat transfer away from the integral electronics 122. If desired, the lamp 50 also may include a thermally conductive bonding material or potting material between the adjacent components, e.g., the housing 54, the connection mount 68, and the board 120. For example, a potting material 124 may be disposed between the cross-mounted board 120 and the interior of the housing 54. Additional features of each respective embodiment of FIGS. 8-11 are discussed in detail below.

The lamp 50 of FIG. 8 further includes a thermal transfer member 126 extending from the cross-mounted board 120 into the connection mount 68. The thermal transfer member 126 may comprise one or more heat pipes, heat sinks, solid conductive numbers, and so forth. In the illustrated embodiment, the thermal transfer member 126 is coupled to the cross-mounted board 120. A solder or other thermally conductive material also may be used to provide an effective thermal bond between the board 120 and the member 126. In operation, heat generated by the integral electronics 122 conductively transfers the through the board 120, passes through the thermal transfer member 126, and distributes via the connection mount 68. Again, the thermal transfer member 126 may be coupled to the connection mount 68 via a thermally conductive substance or potting material 128. Upon reaching the connection mount 68, the heat may continue to distribute through an external fixture supporting the lamp 50. Altogether, the heat shielding, transferring, and distribution mechanisms of FIG. 8 represent another alternative thermal distribution mechanism 130 for the lamp 50.

Figure 9:
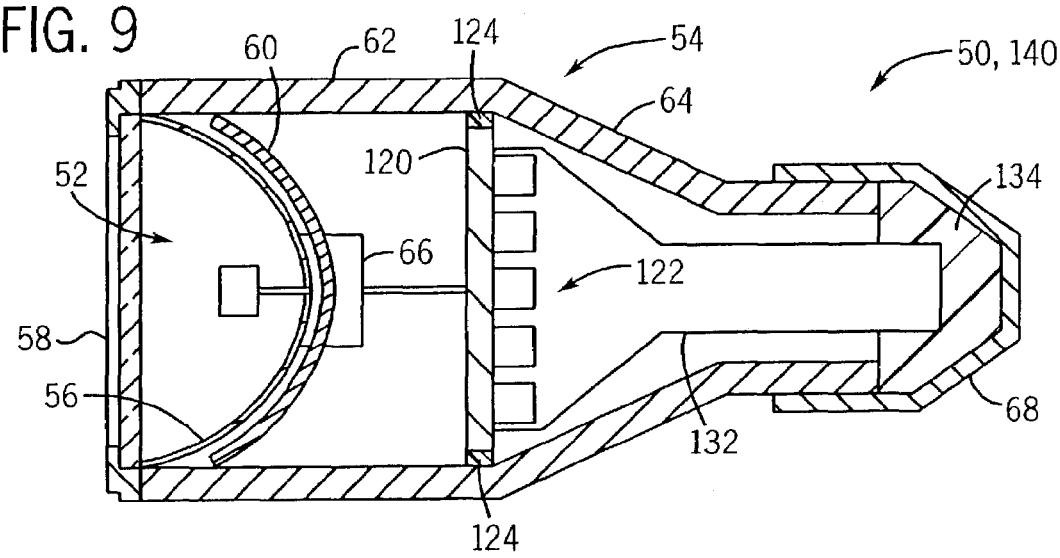

Moving to FIG. 9, the illustrated embodiment further includes a thermal transfer member 132 extending from the integral electronics 122 into the connection mount 68. The thermal transfer member 130 may comprise one or more heat pipes, heat sinks, solid conductive numbers, and so forth. In the illustrated embodiment, the thermal transfer member 130 is coupled to the integral electronics 122, rather than the board 120. A solder, potting material, or other thermally conductive interface also may be used to provide an effective thermal bond between the integral electronics 122 and the member 130. In operation, heat generated by the integral electronics 122 passes through the thermal transfer member 130 and distributes via the connection mount 68. Again, the thermal transfer member 130 may be coupled to the connection mount 68 via a thermally conductive substance or potting material 134. Altogether, the heat shielding, transferring, and distribution mechanisms of FIG. 9 represent another alternative thermal distribution mechanism 140 for the lamp 50.

Figure 10:
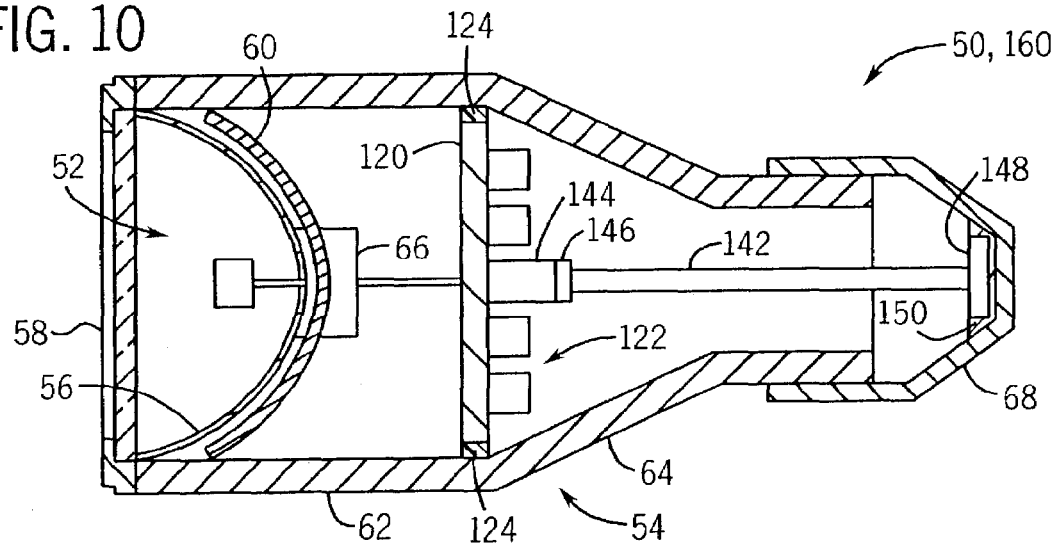

Alternatively, as illustrated in FIG. 10, a heat pipe 142 may be coupled to a specific component 144 of the integral electronics 122. In this exemplary embodiment, the heat pipe 142 has an evaporator plate 146 coupled to the component 144, while a condenser 148 is coupled to the connection mount 68. Again, a thermally conductive substance or potting material may be used to provide a thermally conductive interface. For example, a potting material 150 may be disposed between the condenser 148 and the connection mount 68. The potting material 150 also may be extended around all or part of the condenser 148 and the heat pipe 142. In operation, heat generated by the component 144 passes through the heat pipe 142 and distributes via the connection mount 68. Altogether, the heat shielding, transferring, and distribution mechanisms of FIG. 10 represent a further alternative thermal distribution mechanism 160 for the lamp 50.

Figure 11:
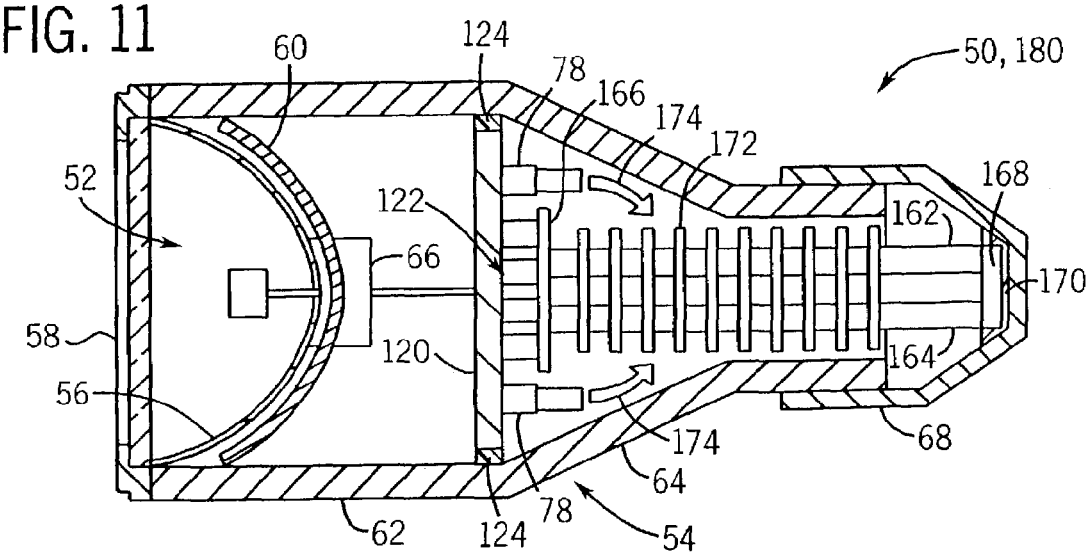
FIG. 11 is a cross-sectional side view illustrating an embodiment of the integral electronics lamp of FIG. 2 having a curved thermal shield, a thermally conductive electronics board, a heat transfer member, and an air-moving device disposed therein.

In the alternative embodiment of FIG. 11, the lamp 50 includes heat pipes 162 and 164 coupled to the integral electronics 122 at an evaporator plate 166. Opposite the evaporator plate 166, the heat pipes 162 and 164 have a condenser 168 coupled to the connection mount 68 via a potting material 170. The heat pipes 162 and 164 are also surrounded by a plurality of heat sinks 172 to improve convective heat transfer. The lamp 50 also has two of the air-moving devices 78 coupled to the board 120 to force air circulation and convective heat transfer, as illustrated by arrows 174. Altogether, the heat shielding, transferring, and distribution mechanisms of FIG. 11 represent a further alternative thermal distribution mechanism 180 for the lamp 50.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims. For example, any one or more of the foregoing thermal shields, heat pipes, heat sinks, air-moving devices, conductive members, potting materials, and so forth may be used to provide a desired thermal profile in an integral electronics lamp.

The invention claimed is:

1. A lamp, comprising:

a housing having a front, a rear, and a longitudinal axis extending between the front and the rear;

a high-intensity-discharge (HID) light source disposed in a first region of the housing, wherein the HID light source is oriented to emit light outwardly from the front of the housing;

integral electronics disposed in a second region of the housing separate from the first region, wherein the integral electronics are electrically coupled to the HID light source;

a thermal shield disposed in the housing longitudinally between the HID light source and the integral electronics;

an electromechanical mount disposed at the rear of the housing, wherein the electromechanical mount is electrically coupled to the integral electronics, and the electromechanical mount is configured to electrically and mechanically couple with an external light fixture;

a conductive member disposed in the second region and coupled to both the integral electronics and the electromechanical mount; and a heat sink, a heat pipe, a fan, or a combination thereof, disposed in the second region and configured to cool the integrated electronics.

2. The lamp of claim 1, wherein the thermal shield comprises a thermally conductive material extending radially outward from the longitudinal axis completely across the housing to an inner surface of the housing.

3. The lamp of claim 1, wherein the thermal shield comprises an insulative material configured to block thermal radiation.

4. The lamp of claim 1, wherein the thermal shield comprises a substantially flat structure.

5. The lamp of claim 1, wherein the thermal shield comprises a curved structure extending about a curved reflector of the HID light source.

6. The lamp of claim 1, wherein the integral electronics comprise a thermally conductive circuit board extending crosswise relative to the longitudinal axis toward an inner surface of the housing.

7. The lamp of claim 6, wherein the housing comprises a thermally conductive material.

8. The lamp of claim 7, comprising the fan and the heat pipe in thermal communication with the integral electronics, wherein the heat pipe extends lengthwise through the housing toward the electromechanical mount.

9. The lamp of claim 1, comprising the heat sink in thermal communication with the integral electronics.

10. The lamp of claim 1, comprising the heat pipe in thermal communication with the integral electronics and the electromechanical mount.

11. The lamp of claim 10, wherein the heat pipe is coupled to a heat sink in thermal communication with the integral electronics.

12. The lamp of claim 1, comprising the fan in thermal communication with the integral electronics.

13. The lamp of claim 12, wherein the fan comprises a miniature fan.

14. The lamp of claim 1, wherein the housing has an elongated cylindrical geometry, and the electromechanical mount comprises an Edison base.

15. The lamp of claim 1, comprising a plurality of heat pipes including the heat pipe extending lengthwise along the housing from the integral electronics to the electromechanical mount.

16. A lamp, comprising:

a single shared housing having a front, a rear, and a longitudinal axis extending between the front and the rear;

a light source comprising an electrode and a reflector disposed in a first region of the single shared housing, wherein the light source is oriented to emit light outwardly at the front of the single shared housing;

a plurality of electronics comprising a ballast disposed in a second region of the single housing;

a thermal shield disposed in the first region between the light source and the plurality of electronics; and a heat sink, a fan, and a heat pipe in thermal communication with the plurality of electronics.

17. The lamp of claim 16, wherein the thermal shield comprises an insulative material completely physically separating the first and second regions.

18. The lamp of claim 17, wherein the thermal shield comprises a thermally conductive material extending radially outward from the longitudinal axis completely across the single shared housing to an inner surface of the single shared housing.

19. The lamp of claim 18, wherein the housing is thermally conductive.

20. The lamp of claim 16, wherein the thermal shield is substantially parallel to the reflector.

21. The lamp of claim 16, wherein the plurality of electronics comprise a thermally conductive circuit board extending at least substantially to an inner surface of the single shared housing.

22. The lamp of claim 21, thermally conductive potting material bridging a gap between thermally conductive circuit board and the single shared housing.

23. The lamp of claim 16, wherein the fan comprises a piezoelectric fan.

24. The lamp of claim 16, wherein the heat pipe extends lengthwise from the plurality of electronics to the rear of the single shared housing.

25. The lamp of claim 16, comprising a plurality of heat pipes including the heat pipe in thermal communication with the plurality of electronics and the single shared housing.

26. The lamp of claim 16, wherein the heat pipe has an evaporator and a condenser at opposite ends of the heat pipe, and the condenser internally coupled to an electromechanical mount disposed at the rear of the single shared housing.

27. The lamp of claim 25, further comprising a plurality of heat sinks coupled to the heat pipe one after another along the heat pipe.

28. The lamp of claim 16, comprising a plurality of miniature fans including the fan in thermal communication with the plurality of electronics.

29. The lamp of claim 16, comprising an Edison base coupled to the rear of the single shared housing, wherein the Edison base is electrically coupled to the plurality of electronics, and the heat pipe is in thermal communication with the Edison base.

* * * * *